United States Patent [19]

Kubo et al.

[11] Patent Number: 4,966,679

[45] Date of Patent: Oct. 30, 1990

[54] METHOD FOR HYDROCRACKING HEAVY FRACTION OILS

[75] Inventors: Junichi Kubo; Kiyoshi Kato; Tadakazu Yamashita; Masaru Sato, all of Yokohama; Hiroshi Kato, Samukawa, all of Japan

[73] Assignee: Nippon Oil Co., Ltd., Tokyo, Japan

[21] Appl. No.: 292,380

[22] Filed: Dec. 30, 1988

Related U.S. Application Data

[63] Continuation of Ser. No. 128,812, Dec. 4, 1987, abandoned.

[30] Foreign Application Priority Data

Dec. 19, 1986 [JP] Japan ..... 61-301723
Dec. 19, 1986 [JP] Japan ..... 61-301724

[51] Int. Cl.[5] ..... C10G 65/12

[52] U.S. Cl. ..... 208/58; 208/56; 208/112; 208/144; 208/145; 208/251 H; 208/217; 208/216 R

[58] Field of Search ..... 208/58, 56, 59, 112, 208/145, 157, 251 H, 217, 216 R

[56] References Cited

U.S. PATENT DOCUMENTS

| | | | |
|---|---|---|---|
| 4,294,686 | 10/1981 | Fisher et al. | 208/56 |
| 4,376,695 | 3/1983 | Belinko et al. | 208/58 |
| 4,430,197 | 2/1984 | Poynor et al. | 208/56 |
| 4,525,267 | 6/1985 | Inooka | 208/112 |
| 4,640,765 | 2/1987 | Kubo | 208/112 |

*Primary Examiner*—Anthony McFarlane
*Attorney, Agent, or Firm*—Bucknam and Archer

[57] ABSTRACT

A method for hydrocracking a heavy fraction oil which comprises cracking a heavy fraction oil in the coexistence of a catalyst and a hydrogen donating solvent such as tetralin while adding a hydrogen-containing gas to the cracking reactor thereby inhibiting the formation of carbonaceous substances and precursors thereof and then hydrogenating the reaction products in the presence of a solid catalyst while adding a hydrogen-containing gas to the hydrogenating reactor thereby to convert the toluene-insoluble carbonaceous substances and precursors thereof to toluene-soluble ones, thus causing no clogging in an apparatus used.

14 Claims, 3 Drawing Sheets

METHOD FOR HYDROCRACKING HEAVY FRACTION OILS

This is a continuation of application Ser. No. 128,812, filed Dec. 4, 1987, now abandoned.

BACKGROUND OF THE INVENTION

1. Field of the Invention

The present invention relates to a method for hydrocracking heavy fraction oils, particularly those containing at least 1.0 wt. % of asphaltene, that is, pentane-insoluble ingredients, using a hydrogen donating solvent.

2. Description of the Prior Art

The hydrogenolysis of heavy fraction oils has recently been used to a greater extent. Thus, there have been proposed many methods for thermalcracking, catalytic cracking, hydrogenolysis, etc.

The heavy fraction oils used herein are hydrocarbon oils containing at least 50 wt. % of a fraction boiling at 350° C. or higher, particularly heavy fraction oils containing at least 1.0 wt. % of pentane-insoluble ingredients, and they include residual oils obtained by the atmospheric or reduced pressure distillation of crude oils, and oils obtained from coal, oil shale, oil sand, bitumen, superheavy crude oils and the like. The term "cracking" used herein is intended to indicate processes which give light fraction oils including naphtha, gasoline, kerosene and gas oil fractions by hydrocracking the heavy fraction oils.

The most serious and troublesome problems raised by the cracking of heavy fraction oils are, in general, the formation of carbonaceous materials and the clogging of various parts of an apparatus for the cracking with the carbonaceous materials. Further, the serious problem caused by the catalytic cracking of the heavy fraction oils is a decrease in catalytic activity of the catalyst used. Still further, the cracking of the heavy fraction oils raises a problem as to an increase in amount of hydrogen consumed. These problems are rendered more serious as the heavier are the fraction oils to be cracked.

One of methods for solving these problems is a method comprising the use of a hydrogen donating solvent (For example, U.S. Pat. No. 4,430,197). It is well known that compounds obtained by hydrogenating polycyclic aromatic compounds, for instance, Tetralin (tetrahydronaphthalene), serve as a hydrogen donor and that catalysts are not necessarily required for the hydrogenolysis of heavy fraction oils with the use of such a hydrogen donating solvent, and this reaction proceeds under a comparatively low hydrogen pressure (For example, U.S. Pat. No. 4,294,686 and Oil & Gas Journal, Nov. 22, 1982, pp. 111–116). The above method so known have very often been attempted to be used industrially (For example, U.S. Pat. No. 2,953,513). It is also known that such hydrogen donating substances are contained in thermocracked oils, catalytically cracked oils, hydrocracked oils and the like and function, per se, as an effective hydrogen donating solvent (For example, U.S. Pat. No. 3,970,545).

In these known methods, since the cracking reaction takes place effectively only at comparatively high temperatures, the carbonaceous substances or precursors thereof are produced at the time of the cracking and clog the various parts an apparatus for the cracking thereby hindering the long-term safe operation of the apparatus, this being the most serious problem.

Further, Japanese Pat. Appln. Laid-Open Gazette No. 61-235492 which corresponds to U.S. Pat. No. 4,640,765 discloses that partitions made from a solid catalyst are provided in a reaction tower to generate natural circulation of a liquid thereby obtaining the necessary liquid flow velocity to avoid clogging and the like with carbonaceous substances and that not only cracking reactions are caused to be effectively carried out, but also the formation of the carbonaceous substances is greatly reduced owing to the presence or use of a catalyst capable of hydrogenation in the reaction tower.

The above techniques so disclosed enable the formation of carbonaceous substances and precursors thereof to be greatly inhibited, but they still permit small amounts of the carbonaceous substances and precursor thereof to be produced thereby raising problems as to clogging in the devices and piping used downstream of the reaction tower.

SUMMARY OF THE INVENTION

The object of the present invention is to provide a method for effectively cracking heavy fraction oils containing at least 1.0 wt. % of asphaltene in the presence of a hydrogen donating solvent while inhibiting the formation of carbonaceous substances and lessening the clogging of the apparatus used for the cracking.

The present inventors made various researches in the formation of carbonaceous substances at the time of cracking of heavy fraction oils and then found the following.

(1) It is most effective to have a hydrogen donating solvent and a suitable catalyst coexist in a cracking reactor in order to inhibit carbonaceous substances from forming in the cracking reactor.

(2) It is effective at the time of cracking that the amount of the catalyst present in the cracking reactor be larger than a certain amount to inhibit the formation of carbonaceous substances.

(3) It is necessary that the catalyst used be high in catalytic activity to a certain extent and be capable of hydrogenation to attain effective inhibition.

(4) It is possible to inhibit the formation of carbonaceous substances by maintaining at lower than a certain level a ratio of the amount of the starting heavy fraction oils treated to the amount of the catalyst used in the cracking reactor, the ratio being a liquid hourly space velocity (LHSV).

(5) It is effective to increase the linear velocity of the liquid passing through the catalyst in the cracking reactor in order to avoid the clogging with the carbonaceous substances therein.

(6) It is most suitable that the catalyst be filled to form a fixed bed in the cracking reactor.

(7) The formation of the carbonaceous substances and precursors thereof in the cracking reactor will be inhibited by meeting the above various requirements; however, small amounts of the carbonaceous substances and precursors thereof still produced will be converted to toluene-soluble substances by a downstream fixed bed hydrogenating reactor maintained under suitable conditions.

(8) The suitable conditions under which the hydrogenating reactor is maintained are that the catalyst is present in at least a certain amount by volume relative to the volume of the reactor, the LHSV is kept suitably low, the hydrogenating activity of the catalyst is high and the temperature thereof is low as compared with that of the cracking reactor.

The present invention is based on the above findings. More particularly, the above findings were utilized and the reactor was discussed from the view-point of economy to accomplish the present invention.

The method for cracking a heavy fraction oil according to the present invention, comprises (1) introducing a heavy fraction oil containing at least 1 wt. % of asphaltene (pentane-insoluble ingredients), a hydrogen donating solvent and a hydrogen-containing gas into (i) a cracking reactor in which at least one partition holding therein a solid catalyst in a total amount of at least 20% by volume of the interior of the cracking reactor is provided thus dividing the interior of the reactor into at least two parts, the divided parts communicate with each at the upper and lower ends of the interior of the reactor, and the liquid (the oil and solvent) interiorly circulates at a linear speed of at least 2 cm/sec. around at least one partition in the reactor or (ii) a cracking reactor in which a solid catalyst is held in an amount of at least 20% by volume of the interior of the cracking reactor and in the form of an upstream fixed bed, and the liquid (the oil and solvent) is exteriorly circulated so that the liquid passes through the fixed bed at a linear velocity of at least 2 cm/sec., (2) cracking the starting heavy fraction oil at a LHSV of not higher than 1 ($hr^{-1}$) (oil/catalyst) while adding hydrogen in such an amount that the amount of hydrogen consumed is at least 1 $Nm^3$/kl-starting oil/%-cracking conversion so as to inhibit the formation of toluene-insoluble carbonaceous substances and precursors thereof in the cracking reactor (i) or (ii), (3)(i) passing the liquid and gases from the cracking reactor (i) to a hydrogenating reactor holding therein at least 50 vol. %, based on the interior of the hydrogenating reactor, of a solid catalyst in the form of a filler layer and maintained at a temperature lower than the cracking reactor or (ii) recycling a part of the liquid from the reactor (ii) and passing the remaining liquid and the gases from the reactor (ii) to the same hydrogenating reactor as above, and then (4) hydrogenating the thus passed materials at a LHSV of not higher than 0.5 ($hr^{-1}$) (oil/catalyst) while adding hydrogen to the hydrogenating reactor in such an amount that the amount of hydrogen consumed is at least 3 $Nm^3$/kl-starting oil/%-cracking conversion thereby to convert the toluene-insoluble carbonaceous substances and precursors thereof to toluene-soluble ones.

BRIEF DESCRIPTION OF THE DRAWINGS

A better understanding of the method of the present invention may be had from a consideration of the following detailed description, taken in conjunction with the accompanying drawings, in which.

DETAILED DESCRIPTION OF THE INVENTION

Figure 1:
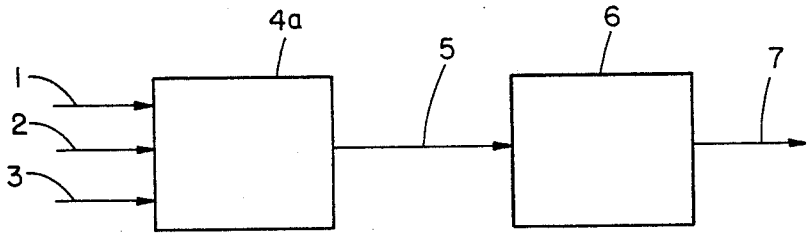
FIG. 1 is a block diagram illustrating a method for cracking heavy fraction oils according to the present invention.

Referring now to FIG. 1, a starting heavy fraction oil 1, a hydrogen donating solvent 2 and a hydrogen-containing gas 3 are introduced into a cracking reactor **4*a*. The cracking reactor 4*a* holds a solid catalyst in an amount of at least 20% by volume of the interior of the reactor. The cracked heavy fraction oil, hydrogen donating solvent and hydrogen-containing gas in the cracking reactor are then introduced, as the reaction mixture 5 and without being separated, into a hydrogenating reactor 6. The reactor 6 holds a catalyst in an amount of at least 50% by volume of the interior of the reactor 6. Carbonaceous substances and precursors thereof are inhibited from being formed in the cracking reactor 4*a* owing to the effects caused by the coexistence of the hydrogen donating solvent and the catalyst, but they are still formed in a small amount. The carbonaceous substances and precursors thereof so still formed are hydrogenated for solubilization in the hydrogenating reactor 6. Thus, the resulting hydrogenation reaction mixture 7 does not substantially contain such carbonaceous substances and precursors. In industrial apparatuses, such a hydrogenation reaction mixture 7 is generally fractionated to obtain various fractions and recover the hydrogen donating solvent for recycled use. The hydrogenating reactor 6** used is of the usual type which holds therein a solid catalyst in the form of a filler layer.

Figure 2:
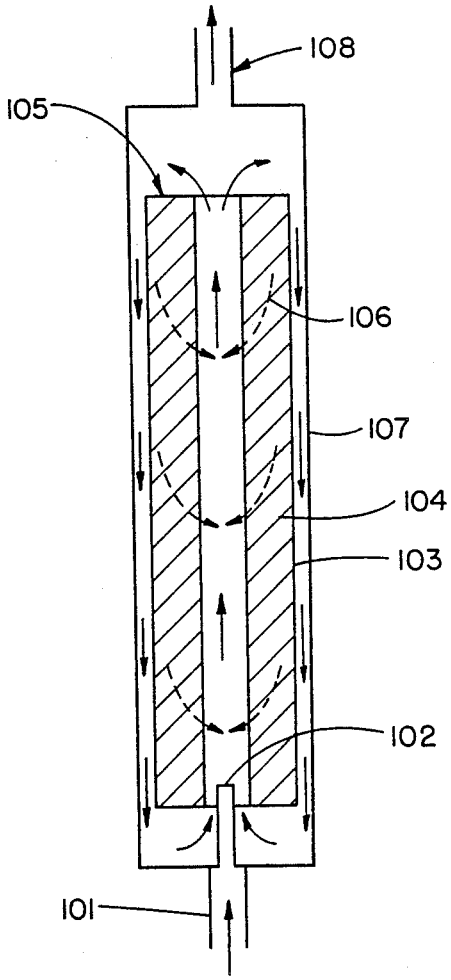
FIG. 2 is a schematic diagram showing the longitudinal section of a cracking reactor used in the present invention.

With reference to FIG. 2, a starting heavy fraction oil, a hydrogen donating solvent and a hydrogen-containing gas are introduced into a cracking reactor at the inlet 101 and through a distributor 102. The interior of the cracking reactor is vertically divided into two portions by a hollow cylindrical or annular partition 105 holding therein a solid catalyst 104 by a punching metal 103, the two portions communicating with each other at the upper and lower ends of the partition. It is necessary that the introduced hydrogen-containing gas flow through the inner portion of the cylindrical partition 105 without flowing through outside the partition. It is the same for the starting oil and hydrogen donating solvent. The hydrogen-containing gas made to take a bubble form ascends through the inner portion of the partition 105.

Thus the zone in which the hydrogen-containing gas is present has a low specific gravity thus causing pressure imbalance in the cracking reactor, and, therefore, a part of the liquid in the cracking reactor is circulated in the direction indicated by the arrow mark 107 in said reactor.

In addition, a part 106 of the circulated liquid can pass through the partition 105 holding the catalyst 104 in the direction from the outside (where the hydrogen-containing gas is absent) of the partition to the inside (where the hydrogen-containing gas is present) thereof. The said direction is indicated by the dotted arrow line.

In this manner, a circulating flow is caused to occur and a necessary liquid flow velocity is ensured by providing the partition 105 in the cracking reactor.

The hydrogen-containing gas ascends through the inner part of the cylindrical partition 105 and discharges out of the cracking reactor at the outlet 108, while the liquid circulates for a predetermined residence time and then discharges out of the reactor at the outlet 108.

The partition holding the solid catalyst therein, used herein, is porous as a whole, and a part or the whole of the porous body is made of a solid catalyst. The partition is, as a whole, in the form of a porous flat sheet or curved sheet, and a part or the whole of the sheet is constituted of solid catalyst particles.

The mesh size of wires or punching metals in which the solid catalyst is held, may be such that the solid catalyst does not just pass the mesh and the liquid is allowed to satisfactorily contact with the solid catalyst particles.

Figure 3:
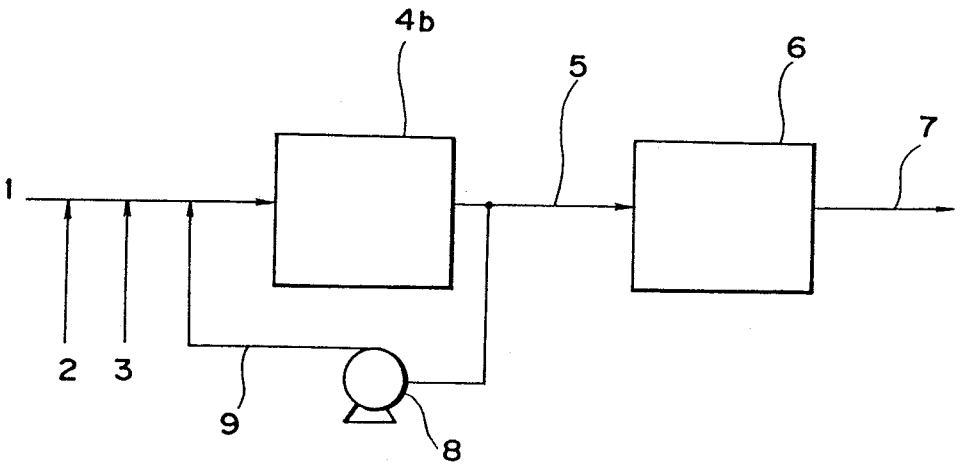
FIG. 3 is a block diagram illustrating another method for cracking heavy fraction oils according to the present invention.

With reference to FIG. 3, a starting heavy fraction oil 1, a hydrogen donating solvent 2 and a hydrogen-containing gas 3 are introduced into a cracking reactor **4*b*. The cracking reactor 4*b* holds a solid catalyst in an amount of at least 20% by volume of the interior of the reactor. A part of the liquid cracked here, carbonaceous substances produced here and the hydrogen-containing gas are, as the cracked reaction mixture 5 and without being separated, into a hydrogenating reactor 6**.

The remainder of the liquid cracked in the cracking reactor **4*b* is, directly or preferably after separation of the hydrogen-containing gas from the liquid, introduced, as the circulating liquid, into the cracking reactor 4*b* by a forced means such as a circulation pump 8**. In a case where a small amount of the hydrogen-containing gas is coexistent with the liquid, it is not necessary to separate said gas from the liquid.

The cracking reactor **4*b*** is of the type in which a usual fixed bed holding a solid catalyst is provided so that the gas-liquid mixture flows upward. In addition, a reactor disclosed in Japanese Pat. Appln. Laid-Open Gazette No. 61-235492 may also be used.

In the present invention, the amount of the catalyst used in the cracking reactor is at least 20%, preferably 30–95% and further preferably 50–70%, by volume of the interior of the reactor. The use of the catalyst is an amount of less than 20 vol. % will exhibit unsatisfactory catalytic effects and unsatisfactory inhibitory effects on the formation of carbonaceous substances in the cracking reactor.

On the other hand, the amount of the catalyst used in the hydrogenating reactor is at least 50%, preferably 60–95% by volume of the interior of the said reactor. The use of the catalyst in an amount of less than 50 vol. % will fail to make the best use of the volume of the hydrogenating reactor, this being undesirable from the economical view-point.

In the present invention, it is necessary to maintain the linear velocity of the liquid at at least 2 cm/sec., preferably at least 3.5 cm/sec. in order to prevent the pressure loss from increasing in the cracking reactor. This may be attained by causing an internal circulating liquid flow to occur in the interior of the cracking reactor as indicated in FIG. 1 or by causing an external circulating liquid flow to take place as shown in FIG. 3. The internal circulating liquid flow is detailed in Japanese Pat. Appln. Laid-Open Gazette No. 61-235492 and it may be naturally generated by provision of the partition in the cracking reactor as mentioned above and outlined in FIG. 2 or may also be forcibly generated by provision of a pump or the like at the distributor located in the lower part of the partition.

The most serious problem occurs in the case where heavy fraction oils are cracked is the formation of carbonaceous substances and the consequent clogging. The problem may be somewhat solved by the use of the hydrogen donating solvent, but carbonaceous substances are still formed whereby the reactor, other devices and piping are clogged, this hindering the operation of stable cracking. In general, the cracking is effected without the use of the catalyst in a case where the hydrogen donating solvent is used. In this case, however, the formation of carbonaceous substances and precursors thereof is greatly inhibited by using a hydrogenating catalyst. It is preferable that the hydrogenating catalyst used herein be a catalyst capable of hydrogenation and demetallization. By using such a preferable catalyst, heavy metals, such as vanadium and nickel, contained in a heavy fraction oil are removed and attached to the catalyst while cracking the oil, whereby the amount of the heavy metals being brought into the next hydrogenating reactor decreases thus greatly preventing the catalyst in the hydrogenating reactor from deteriorating in catalytic activity.

Further, it is necessary that the catalyst used in the cracking reactor have higher catalytic activity than a certain level. It is effective for inhibiting the formation of carbonaceous substances that the catalyst is present in a comparatively large amount in the cracking reactor and the ratio of the amount of the oil treated to that of the catalyst in the reactor, that is a LHSV, is made low.

In the case where the catalyst used is a presently commercially available one, it is necessary that the LHSV in the cracking reactor be 1 ($hr^{-1}$) or lower, preferably 0.1–0.8 ($hr^{-1}$), and that in the hydrogenating reactor be 0.5 ($hr^{-1}$) or lower.

It is the amount of hydrogen consumed that indicates how far or to what extent the formation of carbonaceous substances is inhibited in the present invention. This is because a large amount of hydrogen consumed means that the cracked products are hydrogenated for the stabilization thereof, this being considered to express the function of the catalyst.

In general, the carbonaceous substances and precursors thereof are expressed in terms of toluene-insoluble ingredients (wt. %).

Assuming that the amount of toluene-insoluble ingredients contained in the liquid at the outlet of the cracking reactor should be up to 1 wt. % and that in the liquid at the outlet of the hydrogenating reactor should be up to 0.05 wt. % to allow an apparatus used in the present invention to stably operate without raising the problem as to the clogging of the apparatus with carbonaceous substances formed, the amount of hydrogen consumed in the cracking reactor should be at least 1 $Nm^3$/kl-starting oil/%-cracking conversion (the amount of hydrogen consumed per cracking conversion 1%), preferably 1.2–10 $Nm^3$/kl-starting oil/%-cracking conversion, and that in the hydrogenating reactor should be at least 3 $Nm^3$/kl-starting oil/%-cracking conversion, preferably 5–150 $Nm^3$/kl-starting oil/%-cracking conversion. In other words, it is necessary for the above purpose that the amounts of hydrogen corresponding to those consumed as indicated above be supplied respectively to the cracking and hydrogenating reactors.

The term "cracking conversion" used herein is defined as follows:

$$\frac{\text{The total amount (g) of cracked products} - \text{the amount (g) of the portion of the cracked products which is boiling at higher temperatures than the initial point of starting oil}}{\text{The amount (g) of starting oil}} \times 100\%$$

It is effective to fluidize the catalyst in the cracking reactor in order to prevent clogging in the apparatus for cracking, but, to this end, a complicated apparatus is required and the catalyst concentration decreases, this being undesirable. In the case where the heavy fraction oil is cracked in the presence of both the hydrogen donating solvent and the catalyst, carbonaceous substances and precursors thereof will be produced in the form of fine particles and they will be easily carried away by the flow of the liquid. It is accordingly unnecessary to fluidize the catalyst particles in order to avoid the clogging in the cracking reactor, and the clogging may be avoided by maintaining the linear velocity of the liquid at 2 cm/sec. or higher in the cracking reactor.

The carbonaceous substances and precursors thereof so carried away from the cracking reactor are subjected to hydrogenation treatment for solubilization in the subsequent hydrogenating reactor. The above is an important finding which the present inventors have experimentally found, and it is due to the fact that the preceding cracking is effected in the presence of both the hydrogen donating solvent and the catalyst. These facts according to the present invention permit the formation of carbonaceous substances, which has heretofore been inevitable at the time of cracking heavy fraction oils, to be substantially prevented.

When the cracking is carried out in the presence of both the hydrogen donating solvent and the catalyst, it will proceed at comparatively low temperatures and pressures although conventional cracking in the presence of only the hydrogen donating solvent requires high temperatures. In the method of the present invention, the temperature of the cracking reactor may be in the range of 380°–470° C. to effect the cracking. In addition, considerably high hydrogen pressures are not necessary for the cracking, and pressures of 30–150 $Kg/cm^2 \cdot G$ are satisfactory therefor because of the presence of the hydrogen donating solvent.

On the other hand, it is necessary that the hydrogenating reactor be maintained at lower temperatures (10°–80° C.) than the cracking reactor. The reason for this is that a small amount of carbonaceous substances and precursors thereof produced in the cracking reactor is hydrogenated for solubilization and the formation of such carbonaceous materials is prevented in the hydrogenating reactor.

The temperature and pressure used in the hydrogenating reactor are 330°–440° C. and 30–150 $Kg/cm^2 \cdot G$, respectively.

In the present invention, the hydrogen donating solvent may be added in a ratio of the solvent/the starting oil by weight of 0.3–3, preferably 0.5–2.

In the subsequent hydrogenating reactor, the hydrogenation of the cracked products and hydrogen donating solvent is mainly carried out. By this hydrogenating reaction, the carbonaceous substances and precursors thereof produced by the preceding cracking reaction are hydrogenated for solubilization and the cracked oil products are simultaneously subjected to hydrofining such as hydrodesulfurization and hydrodenitrification.

The hydrogen donating solvents used in the present invention may be hydrocarbons containing at least 30 wt. % of the hydrides of polycyclic aromatic hydrocarbons. The polycyclic aromatic hydrocarbons include bicyclic to hexacyclic, preferably bicyclic to tetracyclic, aromatic hydrocarbons and derivatives thereof such as naphthalene, anthracene, phenanthren, pyrene, naphthacene, chrysene, benzopyrene, perylene, picene and derivatives thereof. In addition, compounds boiling in the range of 150°–500° C. and containing at least 30 wt. % of the hydrides of polycyclic aromatic hydrocarbons, may also be used as a hydrogen donating solvent, and they include cycle oils in an apparatus for catalytic cracking (FCC), bottom oils in catalytic reforming apparatus, bottom oils in an apparatus for thermocracking naphtha, and other oil products obtained from petroleum refining apparatuses, as well as coal-derived products such as tar oil, anthracene oil, creosote oil, coal liquefied oil, and products obtained from tar sand, oil shale, bitumen and the like.

The catalysts used in the present invention are not particularly limited and may be usual ones, but the catalysts used in the cracking reactor are required to have a hydrodemetallizing function and should preferably be such that they will be comparatively little degraded in catalytic activity when heavy metals, such as vanadium and nickel, are attached to them. The catalysts used in the hydrogenating reactor are required to have a hydrodesulfurization function and may therefore be desulfurizing catalysts. These catalysts in the solid form include the oxides and sulfides of Group VIII metals of the Periodic Table such as nickel and cobalt as well as of Group VIB Group metals of the Periodic Table such as molybdenum and tungsten, each carried on alumina, silica, silica-alumina, alumina-boria, silica-alumina-magnesia, silica-alumina-titania and inorganic substances such as natural and synthetic zeolites.

The solid catalyst particles are not particularly limited in shape. They may be spherical in shape and may be formed by extrusion molding or compression molding. It is desirable that these catalysts have a particle size of 0.01–10 mm, preferably 0.1–5 mm.

The hydrogen-containing gas used in the present invention may preferably be a gas containing at least 70 wt. % of hydrogen, which is, for example, a hydrogen-containing gas from reforming apparatuses.

This invention will be better understood by the following Examples and Comparative Examples.

EXAMPLE 1

An experiment was carried out in accordance with FIG. 1 to hydrocrack Arabian Heavy reduced-pressure residual oils. The cracking reactor used in this Example was the internal natural circulation liquid flow-type reactor (Japanese Pat. Appln. Laid-Open No. 61-235492) as shown in FIG. 2. This reactor is of the type in which the interior is partitioned into two parts (inner and outer parts) by the catalyst annularly held in the punching metal and the internal natural circulation of the liquid is caused to take place by passing the hydrogen-containing gas only through the inner (or central) part. The properties of the starting oils, the shape and size of the cracking and hydrogenating reactors, and the operational conditions are indicated in Table 1, 2 and 3, respectively. The hydrogen donating solvent used was tetralin. The starting oil and tetralin were charged in a ratio by weight of 1:1 into the cracking reactor. The resulting reaction products were recovered, freed of the tetralin and then measured for their properties. The operation was successively carried out for 720 hours without increasing the pressure loss. The properties of the products at the outlets of the cracking and hydrogenating reactors, together with those of the starting, are indicated in Table 1. The amounts (wt. %) of the carbonaceous substances are difficultly measurable and are therefore indicated in terms of those of toluene-insoluble ingredients.

The catalyst used was a commercially available extrusion molded type catalyst (particle size: 1/32 inch) consisting of cobalt and molybdenum carried on silica-alumina. After the completion of the experiment, the apparatus used was opened for inspection with the result that no carbonaceous substances are found to deposit in the reactors and piping.

COMPARATIVE EXAMPLE 1

The procedure of Example 1 was followed except that no catalyst was present in the cracking reactor and only the hydrogen donating solvent (tetralin) was present therein for cracking. One hundred and twenty (120) hours after the start of the cracking operation, clogging took place in the pipe at the outlet of the cracking reactor and in the catalyst layer of the hydrogenating reactor thereby increasing the pressure drop, and, therefore, the experiment was stopped. The properties of the products present at the outlets of the cracking reactor and hydrogenating reactor are shown in Table 1.

After the end of the experiment, the apparatus used was opened for inspection with the result that carbonaceous substances were found to deposit even in the piping downstream of the hydrogenating reactor.

COMPARATIVE EXAMPLE 2

Figure 4:
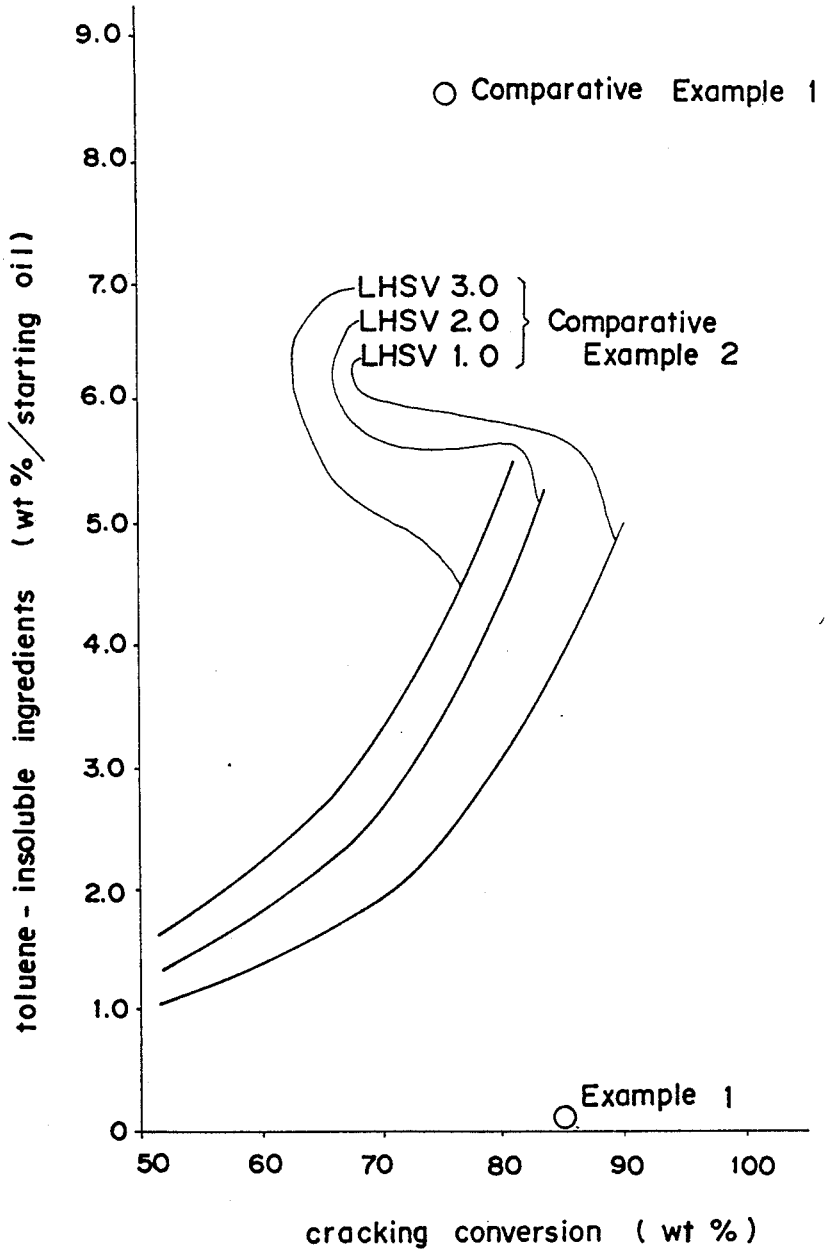
FIG. 4 is graphs showing the relationships between the cracking conversion and the content of toluene-insoluble ingredients in Example 1 and Comparative Examples 1–2.

The procedure of Example 1 or Comparative Example 1 was followed except that the catalyst was placed in the cracking reactor in an amount of 10% by volume of the interior thereof, and the catalyst was fluidized by the internal natural circulating liquid flow. In addition, experiments were made varying the LHSV relative to the catalyst in the cracking reactor by changing the amount of the starting heavy fraction oil charged. The results of these experiments are indicated in FIG. 4. This figure indicates that the amounts (wt. %/starting oil) of the toluene-insoluble ingredients with respect to the cracking rates (545° C. base) at the outlet of the cracking reactor are plotted against the LHSV's as the parameter. This figure also shows the results of Example 1 for comparison.

Further, Table 1 also shows the properties of the products obtained by selecting a LHSV of 1.0.

EXAMPLE 2

An experiment was made to thermocrack Arabian Heavy reduced-pressure residual oils in accordance with the process as shown in FIG. 3. The cracking reactor used had an upstream fixed bed therein and an external circulating liquid flow, and the hydrogenating reactor had a downstream fixed bed therein. The properties of the starting oil, the shape and size of the reactors and the operational conditions, are indicated respectively in Tables 1, 2 and 3. Tetralin was used as the hydrogen donating solvent. The starting oil and tetralin were charged in a ratio by weight of 1:1 into the cracking reactor. The resulting reaction products were recovered, freed of the tetralin and then measured for properties. The operation was continuously performed for 680 hours without increasing the pressure loss. Table 1 shows the properties of the products at the outlets of the cracking and hydrogenating reactors, together with the properties of the starting oil. The carbonaceous substances were difficult to measure and were therefore expressed in terms of toluene-insoluble ingredients.

In addition, the catalyst used was the same as used in Example 1. After the end of the experiment, the apparatus used was opened for inspection with the result that no carbonaceous substances were found to deposit in the reactors and piping.

COMPARATIVE EXAMPLE 3

The procedure of Example 2 was followed except that no catalyst was used in the cracking reactor and the cracking was carried out in the presence of the hydrogen donating solvent only. After the operation had been performed for 100 hours, clogging took place in the cracking reactor, in the pipe at the outlet of the cracking reactor and in the catalyst layer of the hydrogenating reactor thereby increasing the pressure loss and stopping the experiment. The properties of the products at the outlets of the cracking and hydrogenating reactors are shown in Table 1.

Further, after the end of the experiment, the apparatus was opened for inspection with the result that carbonaceous substances were found to deposit even in the cracking reactor, in the piping downstream of the hydrogenating reactor.

TABLE 1

| Item | Starting oil | Example 1 | | Comp. Example 1 | | Comp. Example 2 | |
|---|---|---|---|---|---|---|---|
| Specific gravity (d) | 1.030 | 0.931 | | 0.947 | | 0.941 | |
| Viscosity (cSt) | 148.3 (@ 100° C.) | 28.31 (@ 50° C.) | | 32.15 (@ 50° C.) | | 32.00 | |
| Residual carbon (wt. %) | 23.11 | 5.81 | | 7.58 | | 6.75 | |
| Softening point (°C.) | 43.3 | — | | — | | — | |
| Asphaltene (wt. %) (pentane-insoluble ingredients) | 13.6 | 2.43 | | 3.72 | | 3.19 | |
| Elementary analysis (wt. %) S | 4.81 | 0.70 | | 0.98 | | 0.75 | |
| Elementary analysis (wt. %) N | 0.39 | 0.22 | | 0.27 | | 0.25 | |
| Elementary analysis (wt. %) C | 84.4 | 86.4 | | 86.5 | | 86.7 | |
| Elementary analysis (wt. %) H | 10.0 | 11.6 | | 11.0 | | 11.1 | |
| H/C (atomic ratio) | 1.42 | 1.61 | | 1.53 | | 1.54 | |
| Metal (ppm) V | 142 | 16 | | 51 | | 32 | |
| Metal (ppm) Ni | 50 | 8 | | 22 | | 17 | |
| Cracking conversion (wt. %) | — | 83.5 | 84.3 | 72.8 | 74.7 | 76.9 | 78.1 |
| Toluene-insoluble ingredients (wt. %) | 0 | Outlet of cracking reactor 0.24 | Outlet of hydrogenating reactor 0 | Outlet of cracking reactor 8.57 | Outlet of hydrogenating reactor 3.21 | Outlet of cracking reactor 2.75 | Outlet of hydrogenating reactor 1.40 |
| Amount of hydrogen consumed | | 139 | 100 | 65 | 70 | 73 | 68 |

TABLE 1 -continued

| | | | | | | |
|---|---|---|---|---|---|---|
| ($Nm^3$/kl-starting oil) | | | | | | |
| Amount of hydrogen consumed ($Nm^3$/kl-starting oil/%-cracking conversion) | 1.67 | 125 | 0.89 | 36.8 | 0.95 | 56.7 |

| Item | Starting oil | Example 2 | | Comp. Example 3 | |
|---|---|---|---|---|---|
| Specific gravity (d) | 1.030 | 0.930 | | 0.950 | |
| Viscosity (cSt) | 148.3 (@ 100° C.) | 28.61 (@ 50° C.) | | (35.30 (@ 50° C.) | |
| Residual carbon (wt. %) | 23.11 | 5.66 | | 7.62 | |
| Softening point (°C.) | 43.3 | — | | — | |
| Asphaltene (wt. %) (pentane-insoluble ingredients) | 13.6 | 2.21 | | 3.81 | |
| Elementary analysis (wt. %) S | 4.81 | 0.65 | | 0.97 | |
| Elementary analysis (wt. %) N | 0.39 | 0.20 | | 0.26 | |
| Elementary analysis (wt. %) C | 84.4 | 86.9 | | 86.7 | |
| Elementary analysis (wt. %) H | 10.0 | 11.9 | | 10.8 | |
| H/C (atomic ratio) | 1.42 | 1.64 | | 1.49 | |
| Metal (ppm) V | 142 | 14 | | 53 | |
| Metal (ppm) Ni | 50 | 8 | | 20 | |
| Cracking conversion (wt. %) | — | 84.5 | 85.1 | 73.1 | 74.9 |
| Toluene-insoluble ingredients (wt. %) | 0 | Outlet of cracking reactor 0.21 | Outlet of hydrogenating reactor 0 | Outlet of cracking reactor 8.62 | Outlet of hydrogenating reactor 3.18 |
| Amount of hydrogen consumed ($Nm^3$/kl-starting oil) | | 140 | 102 | 63 | 72 |
| Amount of hydrogen consumed ($Nm^3$/kl-starting oil/%-cracking conversion) | | 1.66 | 170 | 0.86 | 40 |

TABLE 2

| Item | Example 1 | | Comp. Example 1 | | Comp. Example 2 | | Example 2 | | Comp. Example 3 | |
|---|---|---|---|---|---|---|---|---|---|---|
| Kind of reactor | Cracking | Hydrogenating | Cracking | Hydrogenating | Cracking | Hydrogenating | Cracking | Hydrogenating | Cracking | Hydrogenating |
| Inner diameter (mm) | 50 | 30 | 50 | 30 | 50 | 30 | 50 | 30 | 50 | 30 |
| Height (mm) | 2500 | 2500 | 2500 | 2500 | 2500 | 2500 | 2500 | 2500 | 2500 | 2500 |
| Interior volume (l) | 4.9 | 1.8 | 4.9 | 1.8 | 4.9 | 1.8 | 4.9 | 1.8 | 4.9 | 1.8 |
| Type | FIG. 2 | Downstream fixed bed | No catalyst | Downstream fixed bed | Fluidized catalyst | Downstream fixed bed | Upstream fixed bed | Downstream fixed bed | No catalyst | Downstream fixed bed |
| Amount of catalyst (l) | 1.2 | 1.5 | — | 1.5 | 0.5 | 1.5 | 1.5 | 1.5 | — | 1.5 |
| Amount of catalyst/-Interior volume (vol. %) | 50.0 | 83.3 | 0 | 83.3 | 10.0 | 83.3 | 55.0 | 83.3 | 0 | 83.3 |
| Linear velocity of liquid in cracking reactor (cm/s) (Empty basis) | 20.0 | — | 5.0 | — | 5.0 | — | 5.0 | — | 5.0 | — |

TABLE 3

| Item | Example 1 | | Comp. Example 1 | | Comp. Example 2 | | Example 2 | | Comp. Example 3 | |
|---|---|---|---|---|---|---|---|---|---|---|
| Kind of reactor | Cracking | Hydrogenating | Cracking | Hydrogenating | Cracking | Hydrogenating | Cracking | Hydrogenating | Cracking | Hydrogenating |
| Reaction temp. (°C.) | 425 | 350 | 440 | 350 | 420–450 | 350 | 425 | 350 | 440 | 350 |
| Reaction pressure ($Kg/cm^2 \cdot G$) | 70 | 70 | 70 | 70 | 70 | 70 | 70 | 70 | 70 | 70 |
| LHSV ($hr^{-1}$) | 0.38 | 0.30 | — | 0.30 | 1.0–3.0 | 0.30 | 0.30 | 0.30 | — | 0.30 |
| Solvent ratio (wt) (tetralin/starting oil) | 1.0 | 1.0 | 1.0 | 1.0 | 1.0 | 1.0 | 1.0 | 1.0 | 1.0 | 1.0 |

What is considered or seen from the comparisons between Example 1 and Comparative Examples 1, 2 and between Example 2 and Comparative Example 3, is as follows.

(1) Hydrogenation of cracked products is accelerated and the formation of toluene-insoluble ingredients (carbonaceous substances and precursors thereof) is greatly inhibited in the cracking reactor by using the hydrogen donating solvent and the catalyst in combination, increasing the ratio of volume of the catalyst present in the cracking reactor and keeping a LHSV (starting heavy fraction oil (g/hr)/catalyst (g)) at a low level.

More specifically, as is apparent from Table 1 and FIG. 4, the amounts (wt. %) of the toluene-insoluble ingredients formed are greater in the following increasing order: Example 1< Comparative Example 2< Comparative Example 1, and, in addition, Example 2< Comparative Example 3. As is shown in FIG. 4, the amount of toluene-insoluble ingredients formed will increase if a LHSV used increases at the same cracking conversion.

(2) The toluene-insoluble ingredients will decrease in amount by introducing the reaction products into the subsequent hydrogenating reactor for hydrogenation.

As is apparent from Table 1, the amounts of toluene-insoluble ingredients at the outlet of the hydrogenating reactor decrease as compared with those at the outlet of the cracking reactor in Examples 1–2 and Comparative Examples 1–3.

(3) According to the hydrocracking process of the present invention, it is possible to inhibit the formation of carbonaceous substances and precursors thereof in the cracking reactor and reduce toluene-insoluble ingredients to zero at the outlet of the hydrogenating reactor (Table 1).

(4) A small amount of carbonaceous substances and precursors thereof is still produced in the cracking reactor, but the pressure loss in the cracking reactor will not increase by maintaining the linear velocity of the liquid at 2 cm/sec. or higher (the results of Examples 1–2).

(5) The pressure loss will not increase in the hydrogenating reactor. More particularly, the pressure loss in the hydrogenating reactor will not increase since the formation of the carbonaceous substance is inhibited in the cracking reactor and the carbonaceous substances and precursors thereof are solubilized in the hydrogenating reactor.

As is clear from the above results, the cracking method of the present invention is capable of inhibiting the carbonaceous substances, eliminating the problem as to clogging and rendering possible the long-term stable operation of the apparatus for cracking.

The effects obtained by the practice of the present invention are summarized as follows.

(1) The formation of carbonaceous substances and precursors thereof is inhibited.

As previously mentioned, the combined use of the hydrogen donating solvent and the catalyst, the use of the catalyst in an amount larger than a certain one and the maintenance of LHSV at a low level, will enable the carbonaceous substances and precursors thereof to be formed in a reduced amount which is lower than 1/10 of the amount formed in the case of non-use of the catalyst.

(2) Clogging is avoided in the cracking reactor.

As previously mentioned, an increase in the pressure loss will be avoided by maintaining the linear velocity of the liquid at 2 cm/sec. or higher since the carbonaceous substances and precursors thereof are formed in a small amount in the cracking reactor and they have a fine particle size.

(3) Clogging of the piping and devices provided between the cracking reactor and the hydrogenating reactor is avoided.

It has been necessary to remove solid particles (carbonaceous substances) downstream of the cracking reactor in conventional cracking methods. In the method of the present invention, however, it is not necessarily required to remove the solid particles unlike the conventional methods since the carbonaceous substances and precursors thereof may be introduced into the subsequent hydrogenating reactor. For this reason, the piping between the cracking reactor and the hydrogenating reactor can be simplified whereby clogging is avoided.

(4) No clogging takes place in the hydrogenating reactor.

The catalyst is held in the form of a fixed bed in the hydrogenating reactor. The pressure loss will not increase in the hydrogenating reactor since the carbonaceous substances and precursors thereof are solubilized in said reactor in the present invention although an increase in pressure loss in the catalyst layer raises a problem in the conventional methods.

(5) There is no problem as to clogging of the apparatus and piping provided downstream of the hydrogenating reactor.

As mentioned before, there are present substantially no solid matters in the piping and devices provided downstream of the hydrogenating reactor since the carbonaceous substances and precursors thereof are solubilized in said reactor. Accordingly, the hitherto serious problem as to the clogging has been solved by the practice of the present invention.

What is claimed is:

1. In a method of hydrocracking a heavy fraction oil which consists of:

(1) introducing a starting heavy fraction oil containing at least 1 wt. % of asphaltene (pentane-insoluble ingredients), a hydrogen donating liquid solvent and a hydrogen containing gas into a cracking reactor, said reactor having at least one vertical partition whereby said reactor is divided into at least two parts, solid catalyst being placed into one of said parts in a total amount of 20% by volume of the interior of the cracking reactor, said parts communicate with each other at the upper and lower ends of the interior of said reactor, and the liquid comprising said oil and solvent interiorly circulates at a linear velocity of at least 2 cm/sec. around at least said one partition;

(2) the improvement which comprises cracking the starting heavy fraction oil at a liquid hourly space velocity of not higher than 1 ($hr^{-1}$) while adding hydrogen in such an amount that the amount of hydrogen consumed is at least 1 volume of hydrogen per volume of cracked product whereby the formation of toluene-insoluble carbonaceous substances and precursors thereof in the cracking reactor is inhibited;

(3) passing the liquid and gases from the cracking reactor to a hydrogenating reactor holding therein at least 50 vol. %, based on the interior of the hydrogenating reactor, of a solid catalyst in the form of a fixed bed and maintained at a lower temperature than the cracking reactor and then;

(4) hydrogenating the thus passed materials at liquid hourly space velocity of not higher than 0.5 ($hr^{-1}$) while adding hydrogen to the hydrogenating reactor in such an amount that the amount of consumed hydrogen is 5–170 volumes ($Nm^3$) per volume of cracked product, whereby the toluene-insoluble carbonaceous substances and precursors thereof are converted to toluene-soluble materials.

2. The method according to claim 1 wherein the hydrogen donating solvent is the hydrides of polycyclic aromatic compounds.

3. The method according to claim 1 wherein the hydrogen donating solvent boils at 150°-500° C. and is the hydride of a hydrocarbon oil containing aromatic hydrocarbons in an amount of at least 30 wt. %.

4. The method according to claim 1 wherein the catalyst held in the cracking reactor has a hydrodemetallizing function.

5. The method according to claim 1 wherein the catalyst held in the hydrogenating reactor has a hydrodesulfurizing function.

6. The method according to claim 1 wherein the temperature and the reaction pressure in the cracking reactor are 380°-470° C. and 30-150 $Kg/cm^2 \cdot G$, respectively.

7. The method according to claim 1 wherein the temperature and the reaction pressure in the hydrogenation reactor are 330°-440° C. and 30-150 $Kg/cm^2 \cdot G$, respectively.

8. In a method of hydrocracking a starting heavy fraction oil which consists of:

(1) introducing a starting heavy fraction oil containing at least 1 wt. % of asphaltene (pentane-insoluble ingredients), a hydrogen donating liquid solvent and a hydrogen containing gas into a cracking reactor, wherein a solid catalyst is held in an amount of at least 20% by volume of the interior of said cracking reactor and in the form of a fixed bed, and the liquid comprising the oil and solvent is exteriorly circulated so that the liquid passes upwardly through the fixed bed at a linear velocity of at least 2 cm/sec.;

(2) the improvement which comprises cracking the starting heavy fraction oil at a liquid hourly space velocity of not higher than 1 ($hr^{-1}$) while adding hydrogen in such an amount of hydrogen that the amount of hydrogen consumed is at least 1 volume per volume of cracked product whereby the formation of toluene-insoluble carbonaceous substances and precursors thereof in the cracking reactor is inhibited;

(3) recycling a part of the liquid from the cracking reactor and passing the remaining liquid and the gases from the cracking reactor to a hydrogenating reactor and then;

(4) hydrogenating the thus passed materials at a liquid hourly space velocity of not higher than 0.5 ($hr^{-1}$) while adding hydrogen to the hydrogenating reactor in such an amount that the amount of hydrogen consumed is at least 3 volumes ($Nm^3$) per volume of cracked product, thereby to convert the toluene-soluble carbonaceous substances and precursors thereof to toluene-soluble materials.

9. The method according to claim 8 wherein the hydrogen donating solvent is the hydrides of polycyclic aromatic hydrocarbons.

10. The method according to claim 8 wherein the hydrogen donating solvent is boiling at 150°-500° C. and is the hydride of a hydrocarbon oil containing at least 30 wt. % of a polycyclic aromatic hydrocarbon.

11. The method according to claim 8 wherein the catalyst held in the cracking reactor has a hydrodemetallizing function.

12. The method according to claim 8 wherein the catalyst held in the hydrogenating reactor has a hydrodesulfurizing function.

13. The method according to claim 8 wherein the temperature and the reaction pressure in the cracking reactor are 380°-470° C. and 30-150 $Kg/cm^2 \cdot G$, respectively.

14. The method according to claim 8 wherein the temperature and the reaction pressure in the hydrogenating reactor are 330°-440° C. and 30-150 $Kg/cm^2 \cdot G$, respectively.

* * * * *